United States Patent [19]

Yamada

[11] 4,455,859

[45] Jun. 26, 1984

[54] APPARATUS FOR APPLYING PULLING FORCE TO VEHICLE BODY

[75] Inventor: Tatsuzo Yamada, 7-43, Morikitacho, 6-chome, Higashinada-ku, Kobe-shi, Hyogo-ken, Japan

[73] Assignees: Tatsuzo Yamada, Hyogo; Maeda Kiko Company Limited, Osaka, both of Japan

[21] Appl. No.: 362,840

[22] Filed: Mar. 29, 1982

[51] Int. Cl.[3] ..... B21D 1/12

[52] U.S. Cl. ..... 72/447; 72/705

[58] Field of Search ..... 72/308, 446, 447, 705; 254/228, 242

[56] References Cited

U.S. PATENT DOCUMENTS

| | | | |
|---|---|---|---|
| 3,612,482 | 10/1971 | Eck | 72/705 |
| 3,835,692 | 9/1974 | Hoffman | 72/705 |
| 3,891,187 | 6/1975 | Bearden, Jr. . | |
| 3,955,397 | 5/1976 | Meis | 72/705 |
| 4,082,250 | 4/1978 | Allmon et al. . | |
| 4,189,934 | 2/1980 | Kuhn | 72/705 |

*Primary Examiner*—Lowell A. Larson

*Attorney, Agent, or Firm*—Wenderoth, Lind & Ponack

[57] ABSTRACT

An apparatus for applying separate pulling forces to a structure such as a damaged vehicle body includes a post member formed of a back wall and a pair of side walls. The back wall is fastened to the ground by a supporting chain. A vehicle body is pulled by plural towing chains extending around respective first and second sprocket wheels and fixed to a swingable holding member upon extension of a hydraulic cylinder, each of which is mounted on the post member. The side walls of the post member have a plurality of apertures for receiving shafts of the first and second sprocket wheels, of ratchet wheels, of pawls and of the swingable holding member. The pawls are engaged with teeth of the ratchet wheels which are fixed to the first sprocket wheels for preventing return movement of the towing chains.

2 Claims, 8 Drawing Figures

APPARATUS FOR APPLYING PULLING FORCE TO VEHICLE BODY

BACKGROUND OF THE INVENTION

1. Field of the Invention

The present invention relates to an apparatus for applying a pulling force to a vehicle body and to be employed when a sheet metal operation is conducted thereon.

2. Description of the Prior Art

A prior art apparatus for applying a pulling force to structures is so constructed that a single towing chain is lapped or extends over two sprocket wheels, one of the sprocket wheels is mounted at the top of a post member which is mounted on a floor surface, the other sprocket wheel is mounted at the side of the post member. A towing chain, an end of which is fixed to a vehicle body, has applied thereto a pulling force when the top of the post member, namely the sprocket wheel mounted at the top of the post member, is pulled upwardly by means of a hydraulic ram. It is an inconvenience of this arrangement that it is possible to use only a single chain for each post member.

It is an object of the present invention to provide an apparatus capable of applying to a vehicle body multiple pulling forces to multiple portions of the vehicle body.

SUMMARY OF THE INVENTION

To accomplish the foregoing object, there is provided an apparatus for applying pulling forces to structures of a vehicle body, which apparatus comprises a supporting chain, a post member extending vertically and including a back wall and a pair of side walls, the back wall having a plurality of longitudinally aligned apertures to receive an end of the supporting chain, the side walls having therein a plurality of longitudinally aligned apertures for supporting shafts, a towing chain and a swingable holding member pivotally connected to lower portions of the side walls of the post member and having apertures for holding ends of a plurality of towing chains. A hydraulic cylinder has one end pivotally connected to the side walls of the post member and another end pivotally connected to the swingable holding member at a position shifted from the swinging axis line of the swingable holding member. First sprocket wheels, the number of which is equal to that of the towing chains, are connected pivotally and independently to upper portions of the side walls of the post member. Ratchet wheels are fixed to the sprocket wheels, independently and on the same axis, and have pawls for preventing rotation in a direction opposite to the pulling direction of the towing chains. The pawls engage with teeth of the ratchet wheels, are pivotally connected to the post member and are disengageable manually from the teeth in a direction opposite to the direction of engaging with the teeth. Second sprocket wheels change the direction of the towing chains, the number of which is equal to that of the towing chains, and are connected pivotally to a portion of the post member higher than the first sprocket wheels. The apertures of the post member for receiving the second sprocket wheels are selectable according to the position of the first sprocket wheels.

The apparatus further comprises wheels pivotally connected to arms projected from the lower portions of the side walls, and a round shaped wheel mounted between the side plates of the swingable holding member and pivotally connected to the side walls by an axle.

The swingable holding member and the first sprocket wheels are so constructed that two towing chains may be employed.

According to the present invention, it is possible to pull not only a single point but also to or more points of the vehicle body at the same time.

DETAILED DESCRIPTION OF THE INVENTION

The following detailed description is of the best presently contemplated mode of carrying out the invention. This description is not to be taken in a limiting sense, but is made merely for the purpose of illustrating the general principles of the invention since the scope of the invention is best defined by the appended claims.

Figure 1:
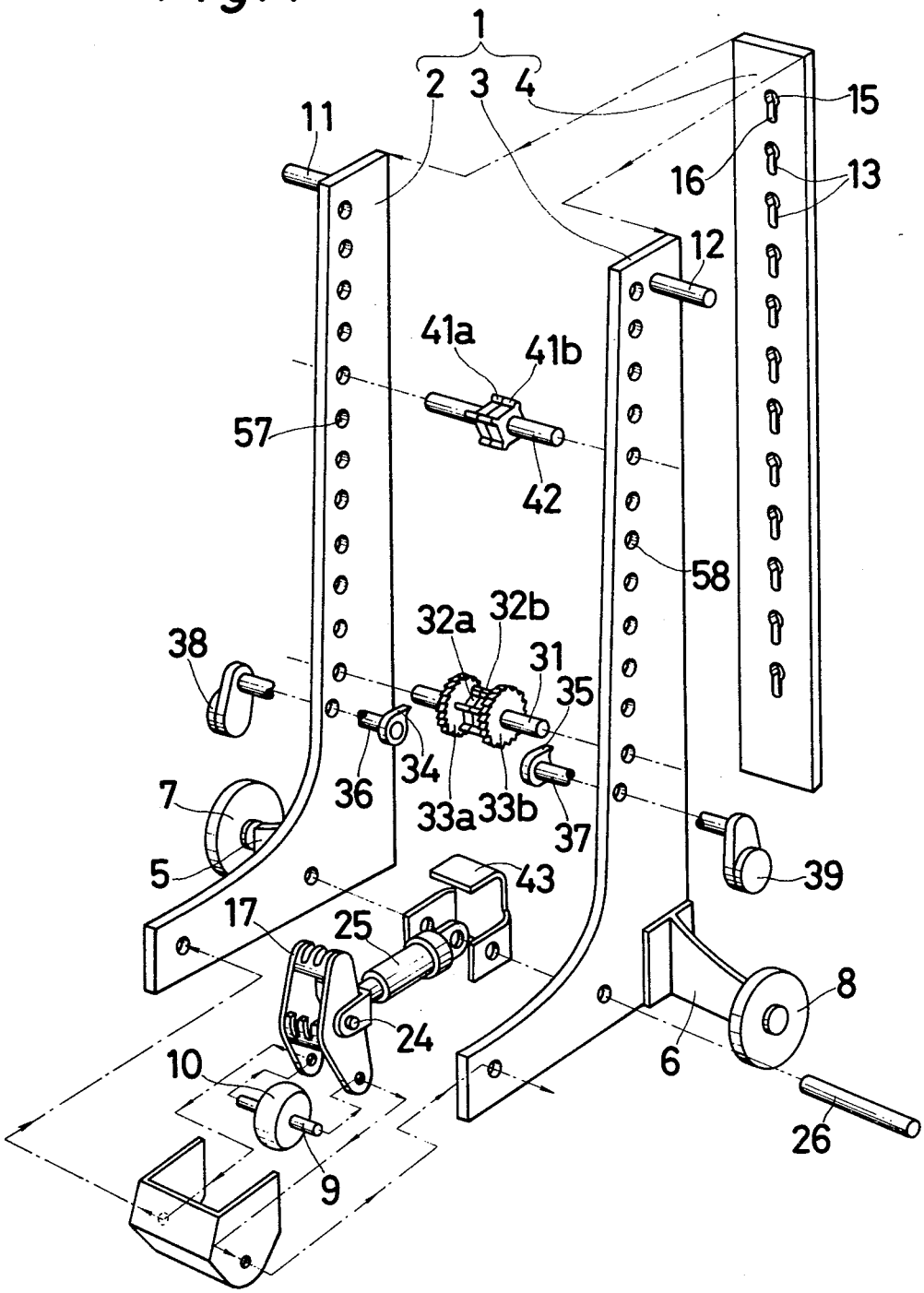
FIG. 1 is an exploded perspective view of an apparatus embodying the present invention.

FIG. 1 is an exploded perspective view of the invention.

A post member 1 is composed of a pair of L-shaped side walls 2 and 3 and a back wall 4. Arms 5 and 6 project outwardly from the lower portions of the side walls 2 and 3, respectively, and rear wheels 7 and 8 are rotatably mounted on the arms. A substantially round shaped front wheel 10 is rotatably mounted between the side walls by a first axle or shaft 9. From upper portions of the side walls 2 and 3, handles 11 and 12 respectively project outwardly. A plurality of aligned apertures 13 are spaced longitudinally along the back wall 4 for fastening ends of a plurality of supporting chains. Each aperture 13 is formed by a passing through hole 15, the diameter of which is larger than the width b (FIG. 2) of the ring of a chain, and an engaging hole 16 extending in the radial direction from the passing through hole 15. The width of the engaging hole 16 is larger than the thickness a (FIG. 2) of the chain ring and smaller than the width b of the ring. A swingable holding member 17 is pivotally mounted between the side walls 2 and 3 by the axle 9.

Figure 2:
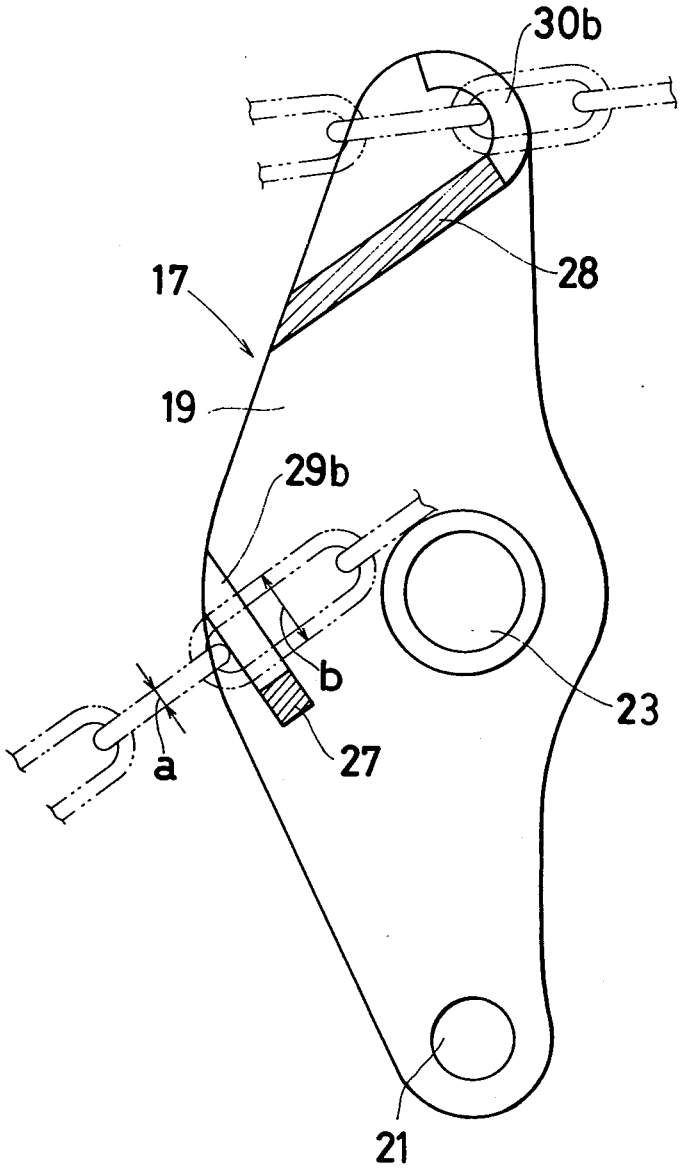
FIG. 2 is a sectional view of a swingable holding member of the apparatus of FIG. 1.
Figure 3:
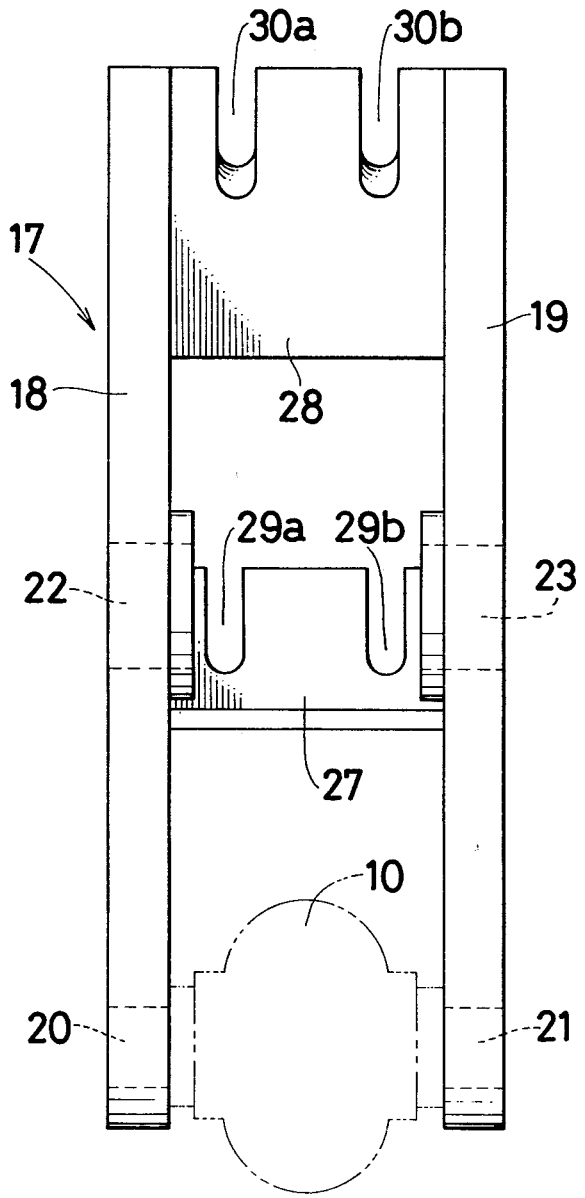
FIG. 3 is a right side view of the swingable holding member.
Figure 4:
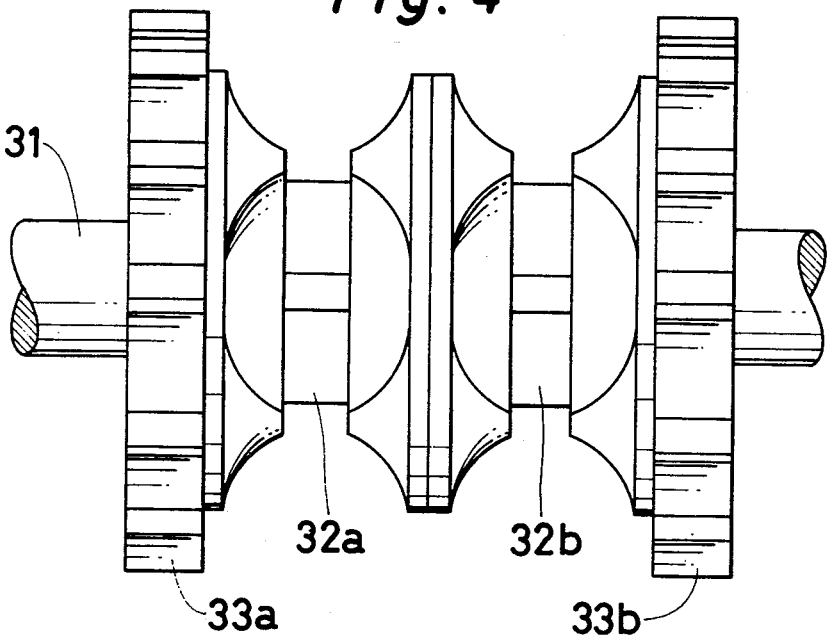
FIG. 4 is a front view of sprocket wheels and ratchet of the apparatus of FIG. 1.
Figure 5:
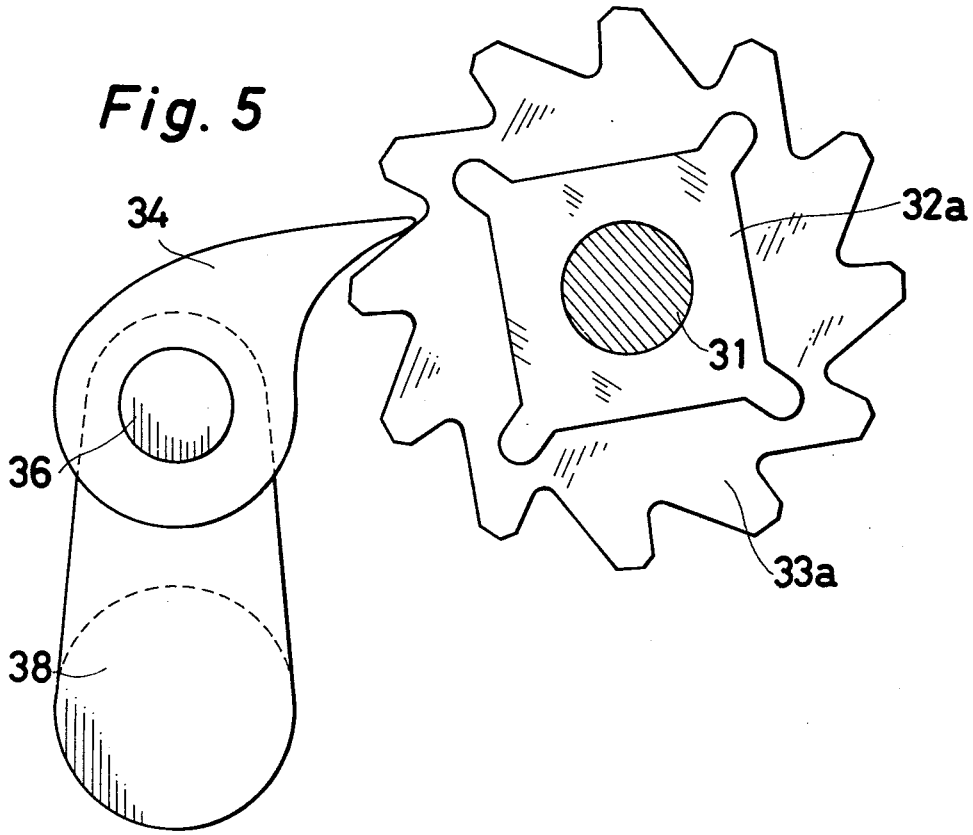
FIG. 5 is a side view of the ratchet wheels and a pawl.

FIG. 2 is a sectional view of the swingable holding member 17, and FIG. 3 is a view from the right side of FIG. 2 of the swingable holding member. The swingable holding member 17 comprises side plates 18 and 19 having apertures 20 and 21 formed in the lower portions thereof. The axle 9 estends through the apertures 20 and 21. Apertures 22 and 23 are formed in the central portions of the side plates 18 and 19. An end of a hydraulic cylinder 25 mounted between the side walls 2 and 3 is pivotally connected to the swingable holding member 17 by a pin 24 passing through the apertures 22 and 23. The other end of the hydraulic cylinder 25 is pivotally connected to the side walls 2 and 3 by a pin 26. A holding bracket 27 is fixed to and extends between side plates 18 and 19 at a location adjacent the apertures 22 and 23. Another holding bracket 28 is fixed to and extends between side plates 18 and 19 at a position on the opposite side of apertures 22 and 23 with respect to apertures 20 and 21. Upwardly opened notches 29*a*, 29*b* and 30*a*, 30*b* are formed respectively in holding brackets 27 and 28. Towing chains catch in notches 29*a*, 29*b* and 30*a*, 30*b*, as in the apertures 13.

First sprocket wheels 32*a* and 32*b* are connected pivotally and independently to the side walls by a common second shaft 31, the position of which is higher than that of the swingable holding member 17. Ratchet wheels 33*a* and 33*b* are fixed rigidly to the sprocket wheels 32*a* and 32*b*, respectively, and have a common axis. Pawls 34 and 35 are fixed rigidly to third shafts 36 and 37, respectively, and the shafts 36 and 37 are connected pivotally to the side walls 2 and 3, respectively. Plumbs or weights 38 and 39 are fixed to the shafts 36 and 37, respectively. The plumbs 38 and 39 provide the shafts 36 and 37 with moments due to gravity, and the direction of the moments are in directions to urge the pawls 34 and 35 to engage with the ratchet wheel 33*a* and 33*b*, respectively. Therefore, rotation of the ratchet wheels in an opposite direction to the towing direction of the towing chain (i.e. a direction such that the towing chain becomes loose) is prohibited. Second sprocket wheels 41*a* and 41*b* for changing the direction of the towing chain are pivotally connected to the side walls 2 and 3 by a shaft 42 at a position which is higher than that of the sprocket wheels 32*a* and 32*b*. A chain supporting member 43 for supporting a loose portion of the towing chain is fixed to lower portions of the side walls 2 and 3.

A plurality of transversely aligned apertures 57 and 58 are spaced longitudinally along the side walls 2 and 3 respectively. A shaft 42 is supported rotatably and removably in the apertures 57 and 58. It is possible that a plurality of shafts 42 are supported in respective pairs of apertures 57 and 58 at different positions along side walls 2 and 3, and that sprocket wheels 41*a* and 41*b* are provided for each of the shafts 42.

Figure 6:
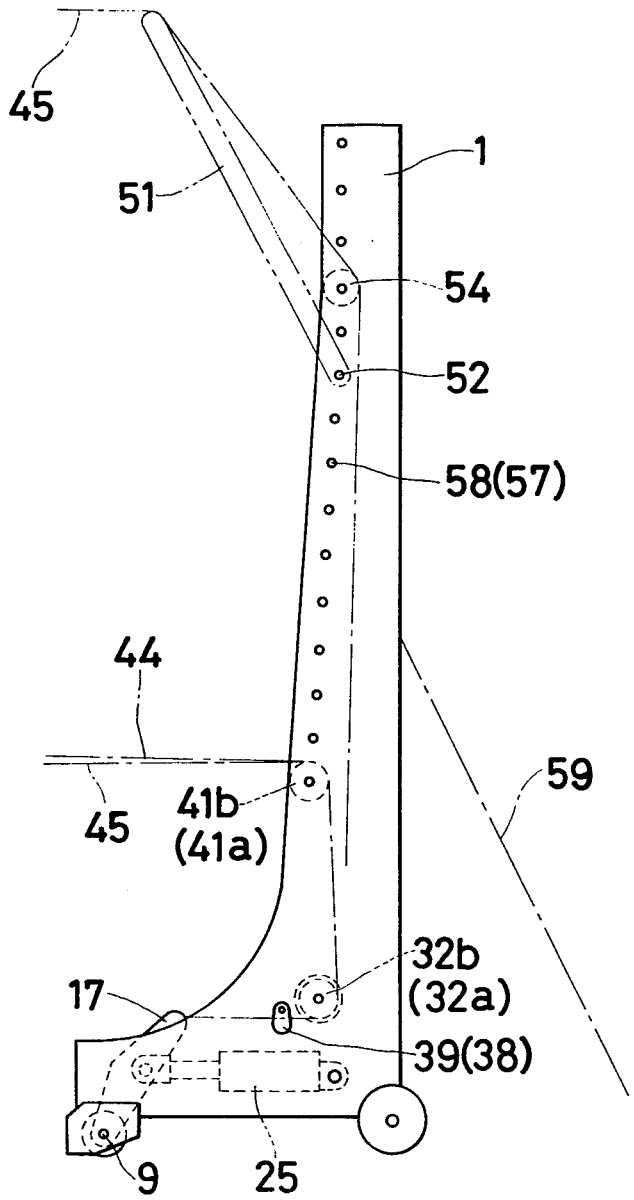
FIG. 6 is a side view illustrating the operating position of the apparatus of the invention.

When applying a pulling force to the surface of a damaged vehicle body, an end of a supporting chain 59 is fixed to an engaging hole 16 at the back wall 4 of the post member 1 which stands on the floor, and the other end of chain 59 is fixed to the floor, as represented in FIG. 6. The sprocket wheels 41*a* and 41*b* are supported by the shaft 42 which is supported at a suitable position along the side walls 2 and 3 in a respective pair of apertures 57 and 58. An end of a towing chain 44 is fixed in a notch 29*a* or 30*a*, while and end of another towing chain 45 is fixed in a notch 29*b* or 30*b*. The towing chains 44 and 45 are lapped around the sprocket wheels 32*a* and 32*b* and are also lapped around the sprocket wheels 41*a* and 41*b*. Both the other ends of the chains 44 and 45 are connected to the damaged vehicle body. In this condition, the hydraulic cylinder 25 being driven to extend, the swingable holding member 17 swings counterclockwise around the axle 9 as viewed in FIG. 6 and the towing chains 44 and 45 are pulled. As the sprocket wheels 32*a* and 32*b* rotate clockwise around the shaft 31 as viewed in FIG. 6, the ratchet wheels 33*a* and 33*b* rotate integrally with the sprocket wheels 32*a* and 33*b*, and counterclockwise rotation of the ratchet wheels 33*a* and 33*b*, and thus of sprocket wheels 32*a* and 32*b*, is prohibited by the pawls 34 and 35. Therefore, the displacement of the towing chains 44 and 45 in a direction opposite to the towing direction is prohibited. When displacement of the towing chains 44 and 45 in a direction opposite to the towing direction is prohibited, the ends of the towing chains 44 and 45 may be disengaged from the notches 29*a*, 29*b* and 30*a*, 30*b* by retracting the hydraulic cylinder 25, and then portions of the towing chains 44 and 45 closer to the sprocket wheels 32*a* and 32*b* are fixed in the notches 29*a*, 29*b* and 30*a*, 30*b*, followed again by the extension of the hydraulic cylinder 25. By repeating the above mentioned operation, it is possible to apply to the damaged body of the vehicle a rightward pulling force as viewed in FIG. 6 by means of the towing chains 44 and 45. The degree of the pulling force and the pulling length per single reciprocating motion of the hydraulic cylinder 25 are determined by the fixing position of the towing chains 44 and 45 in the notches 29*a*, 29*b*, and 30*a*, 30*b*. Therefore, it is possible that a single portion of the damaged body has applied thereto two pulling forces. Also, it is possible that one point of the damaged vehicle body may have applied thereto a pulling force and another point may not have applied thereto a pulling force. In such case, one chain, e.g. the chain 44, may be disengaged from the notch 29*a* or 30*a*, while the other chain, e.g. chain 45, may be engaged in the notch 29*b* or 30*b* and has applied thereto a pulling force. Referring to FIG. 6, when it is required that a pulling force be applied transversely to one point and upwardly to another point, an end 52 of a supporting pole 51 is connected to a pair of the apertures 57 and 58 of side walls 2 and 3 by a pin, and the towing chain 45 is lapped over the other end of the supporting pole 51. The chain 45 is supported and is lapped around the sprocket wheel 41*b* which is pivotally connected to the side walls 2 and 3 by a shaft 54. The towing chain 44 for applying a horizontal force is lapped around the sprocket wheel 41*a* represented in FIG. 6. Therefore, it is possible that the vehicle body has applied thereto both a horizontal pulling force by the chain 44 and also an upward pulling force by the other chain 45.

Figure 7:
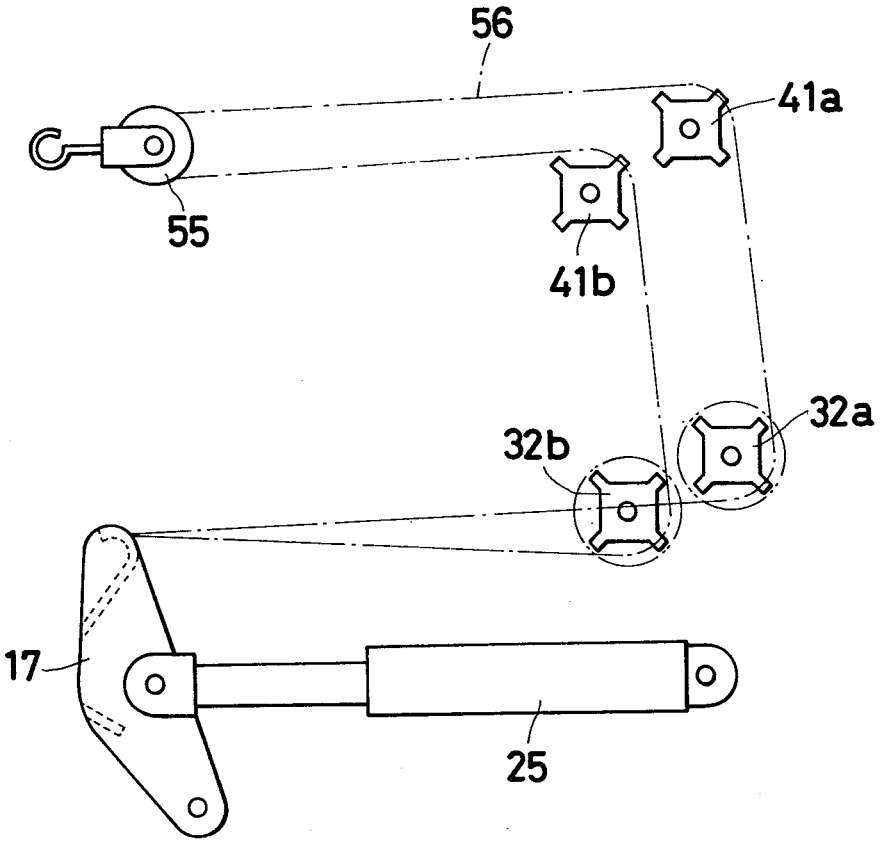
FIG. 7 is a simplified side view illustrating a towing chain lapped on the sprocket wheels and an idle pulley and showing another operating position of the apparatus of the invention.

Also, referring to FIG. 7, it is possible that a vehicle body may have applied thereto a pulling force by a single chain 56 by means of an idle pulley 55.

Figure 8:
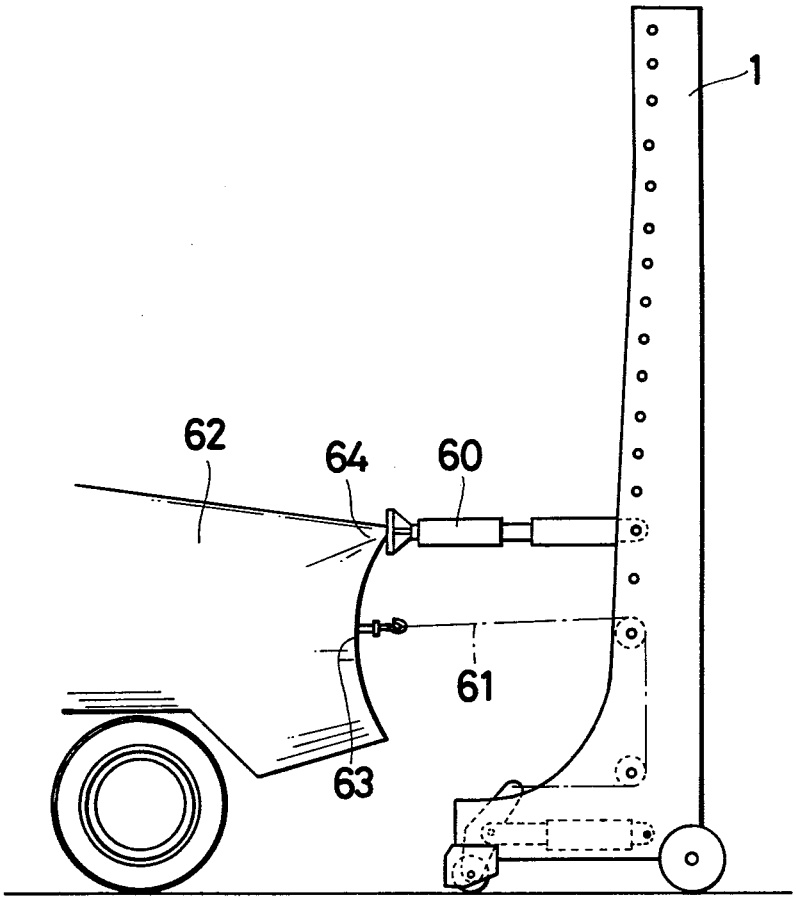
FIG. 8 is a side view illustrating another operating position of the apparatus of the invention.

Furthermore, referring to FIG. 8, a depressed portion 63 of the vehicle body may have applied thereto a pulling force by a chain 61, and a rigid rod 60 may be mounted between the depressed portion 63 of the damaged vehicle body 62 and the post member 1. Thus, the depressed portion 63 may be recovered by applying a pulling force. A hydraulic cylinder may be employed instead of the rigid rod 60.

It is possible that three or more chains may be fixed to the swingable holding member 17 so that three or more points thereof may have applied thereto pulling forces. This type of modification would be quite easy to those skilled in the art.

I claim:

1. An apparatus for applying plural independent pulling forces to a structure, said apparatus comprising:

a post member formed of a pair of spaced generally L-shaped side walls including respective vertical portions and respective horizontal portions extending forwardly from lower ends of said vertical portions, and a back wall joining said vertical portions;

said back wall having therein a plurality of vertically spaced supporting chain receiving apertures, each said aperture including a larger hole of a size to allow passage therethrough of a supporting chain and a smaller hole joining said larger hole and of a size to retain a supporting chain;

said vertical portions of said side walls having therein a plurality of vertically spaced shaft supporting apertures arranged in laterally aligned pairs;

a pair of wheels rotatably mounted laterally outwardly of respective said lower ends of said vertical portions of said side walls;

a swingable holding member formed of spaced side plates, and first and second vertically spaced holding brackets integral with and extending between said side plates, each said holding bracket having therein a plurality of upwardly facing towing chain holding notches;

a substantially rounded front wheel;

a first shaft rotatably supporting said front wheel between said side plates of said holding member and extending through apertures in lower ends of said side plates and apertures in forward ends of said horizontal portions of said side walls, said first shaft thereby pivotally mounting said holding member between said side walls;

a hydraulic cylinder unit having a first end mounted between said horizontal portions of said side walls and a second end pivotally connected to said holding member at a level above said first shaft, such that extension and contraction of said hydraulic cylinder unit pivots said holding member forwardly and rearwardly, respectively, about said first shaft;

a plurality, equal to said plurality of notches in said holding brackets, of first sprocket wheels, each said first sprocket wheel having coaxially fixed thereto a respective ratchet wheel;

a second shaft extending through a selected pair of said apertures in said vertical portions of said side walls and rotatably supporting said first sprocket wheels and respective said ratchet wheels at a level above said first shaft;

a plurality, equal to said plurality of first sprocket wheels, of second sprocket wheels rotatably mounted between said vertical portions of said side walls at selectively changeable positions above the level of said second shaft;

a supporting chain retainable in a selected said aperture in said back wall and adapted to be connected to a floor;

a plurality of towing chains, each said towing chain being retainable adjacent a first end thereof in a respective said notch in a selected one of said first and second holding brackets, each said towing chain extending along an independent path in a first direction from the respective first end thereof to and passing around a respective said first sprocket wheel and then to and passing around a respective said second sprocket wheel and then forwardly, with a second end of each said towing chain adapted to be connected to a structure to which a force is to be applied;

whereby extension of said hydraulic cylinder unit will pivot said holding member forwardly about said first shaft, thereby pulling each said towing chain along an independent path in a second direction opposite to said first direction and causing each said towing chain to apply to the structure an independent pulling force; and means for, upon contraction of said hydraulic cylinder unit and pivoting of said holding member rearwardly, preventing said towing chains from moving in directions opposite to respective said pulling directions thereof, said means comprising a plurality, equal to said plurality of ratchet wheels, of pawls, each said pawl being fixed to a first end of a respective third shaft rotatably supported in a said aperture in a respective said vertical portion of one of said side walls, and a plurality of weight means fixed to second ends of respective said third shafts for urging said third shafts to rotate in respective directions to urge said pawls into engagement with respective said ratchet wheels, thereby to enable rotation of said ratchet wheels and said first sprocket wheels in said pulling directions but to prevent rotation thereof in the reverse directions.

2. An apparatus as claimed in claim 1, wherein said pair of wheels are rotatably mounted on respective arms extending laterally outwardly from said respective lower ends of said vertical portions of said side walls.

* * * * *